United States Patent [19]

Daly et al.

[11] Patent Number: 4,975,081

[45] Date of Patent: Dec. 4, 1990

[54] ELECTRICAL CONNECTOR AND METHOD OF INTERCONNECTING FLAT POWER CABLES

[75] Inventors: John K. Daly, Scottsdale, Ariz.; Songchin S. Lu, Santa Monica, Calif.; Dean A. Puerner, Maricopa; Frederick H. Rider; David S. Szczesny, both of Glendale, all of Ariz.

[73] Assignee: AMP Incorporated, Harrisburg, Pa.

[21] Appl. No.: 454,656

[22] Filed: Dec. 21, 1989

Related U.S. Application Data

[63] Continuation-in-part of Ser. No. 338,079, Apr. 14, 1989, Pat. No. 4,915,650, and a continuation-in-part of Ser. No. 341,864, Apr. 21, 1989, Pat. No. 4,900,264.

[51] Int. Cl.[5] ..... H01R 9/07

[52] U.S. Cl. ..... 439/498; 439/422; 439/465

[58] Field of Search ..... 439/421–424, 439/492–499, 465, 460, 461

[56] References Cited

U.S. PATENT DOCUMENTS

| | | | |
|---|---|---|---|
| Re. 31,336 | 8/1983 | Weinmann et al. | 29/868 |
| 3,336,564 | 8/1967 | McCaughey | 339/99 |
| 4,241,498 | 12/1980 | Brandeau | 29/861 |
| 4,551,579 | 11/1985 | Takasaki | 174/88 R |
| 4,560,224 | 12/1985 | Weisenburger | 439/422 |
| 4,821,409 | 4/1989 | Nager, Jr. | 29/747 |
| 4,859,204 | 8/1989 | Daly et al. | 439/424 |
| 4,867,700 | 9/1989 | Kreinberg | 439/422 |
| 4,902,245 | 2/1990 | Olsson | 439/492 |

FOREIGN PATENT DOCUMENTS

| | | | |
|---|---|---|---|
| 2070347 | 9/1981 | United Kingdom | 439/422 |

*Primary Examiner*—David L. Pirlot
*Attorney, Agent, or Firm*—Anton P. Ness

[57] ABSTRACT

A tap or splice connector especially useful for a pair of dual conductor flat power cables includes two pairs of upper and lower structures which are applied to the stacked in-line cables side-by-side and then enclosed in a housing. The upper and lower structures each have a transverse array of cable-engaging wave-shaped bosses alternating with wave-receiving relief recesses when pressed together, so that the waves press strips of both cables in upper and lower arrays into the opposing recesses thus exposing conductor edges of the strips for electrical connection. Outer surfaces of the structures are then staked to urge the metal thereof laterally and tightly against the conductor edges adjacent thereto. The cables may first be prepared by punching medial slots thereinto at the interconnection site; the structures when applied are spaced from each other; and the housing covers include axial wall sections which extend between the side-by-side structures and through the cable slots, assuring isolation of the circuits. The structures preferably are self-locking upon being staked to secure the upper and lower structures to each other and to the cables. The housing covers may have opposed integral resilient cable-clamping sections to compensate for cable thickness differences.

32 Claims, 10 Drawing Sheets

20
16
20
10
60
3
36
50
6
34
54
56
58
6
54
12
42
44
26
38
28
40
14
3
80
20
22
46
22
18
24
20

ELECTRICAL CONNECTOR AND METHOD OF INTERCONNECTING FLAT POWER CABLES

REFERENCE TO RELATED APPLICATIONS

This is a Continuation-in-part of U.S. Pat. application Ser. No. 07/338,079 filed Apr. 14, 1989, now U.S. Pat. No. 4,915,650 and a Continuation-in-Part of U.S. Pat. application Ser. No. 07/341,864 filed Apr. 21, 1989, now U.S. Pat. No. 4,900,264.

FIELD OF THE INVENTION

The present invention relates to the field of electrical connections and more particularly to interconnecting flat power cables.

BACKGROUND OF THE INVENTION

U.S. Pat. Nos. 4,859,204 and 4,867,700 disclose a transition adapter which is crimped onto a flat power cable by penetrating the insulation covering the cable's conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. U.S. Pat. No. 4,915,650 discloses a similar transition adapter separable into two discrete adapters which is especially useful with dual conductor flat cable, wherein a pair of parallel spaced coplanar flat conductor strips having insulation extruded therearound define power and return paths for electrical power transmission. The adapters have opposed plate sections disposed along respective major surfaces of the cable, the plate sections including termination regions transversely thereacross having arrays of shearing wave shapes alternating with relief recesses of equal width. The wave shapes extending outwardly from the cable-proximate side and toward relief recesses in the opposed plate section, and when the plate sections are pressed together with the cable therebetween, the arrays of wave shapes shear the cable into strips and simultaneously press the sheared strips out of the plane of the cable and into the opposing relief recesses, forming a series of interlocking wave joints with the cable while exposing newly sheared edges of the cable conductor or conductors for electrical connection therewith. Low resistance copper inserts along the cable-remote surfaces of the adapters include wave shapes conforming to the adapter wave shapes so that the sheared conductor strips become disposed between sides of the insert wave shapes, as do the shearing edges of the adjacent wave shapes of the opposing adapter. Thereafter a staking process deforms the metal of the low resistance copper inserts against the conductor edges to define gas-tight, heat and vibration resistant electrical connections with the cable conductor and with the transition adapter, so that the inserts are electrically in series at a plurality of locations between the conductor and the adapter. A contact section is integrally included on the transition adapter and extends from the now-terminated cable end, enabling mating with corresponding contact means of an electrical connector, or a bus bar, or a power supply, terminal, for example.

U.S. Pat. No. 4,900,264 discloses electrical interconnection of one dual (or single) conductor flat power cable to another, forming a splice or a tap interconnection between the cables which mechanically joins the cables and electrically interconnects the respective ones of the pairs of cable conductors. The cables are first stacked with the ones of the conductors of each cable to be interconnected being adjacent each other. A pair of wave crimp structures are associated with each pair of conductors to be interconnected, with a lower one of the structures being disposed transversely below the cables and an upper one being disposed transversely above the cables opposed from the lower one; the two pairs of structures for the two pairs of conductors are spaced from each other along the cables and will both be disposed within a common housing at the interconnection site. Each pair of upper and lower structures define along one half adjacent the conductors to be interconnected, opposing arrays of shearing wave shapes and alternating recesses comprising cooperating shearing edges; the other half of each contains no shearing edges so that no electrical connection is made with the conductors not to be interconnected. The structures will then be pressed against the cable therebetween, shearing strips of the conductors to be interconnected and pressing alternating ones of the strips above and below the planes of the cables and exposing newly sheared conductor edges to be electrically interconnected by metal of the structures. Flanges of the upper and lower structures extend outwardly beyond both lateral edges of the cables and converts, and rivets are placed through aligned flange holes and staked to lock the structures to each other sandwiching the cables therebetween. The wave shapes of the low resistance metal insert of the structure are staked to deform the metal tightly against adjacent sheared conductor edges of the conductor strips between the insert wave shapes, defining a plurality of gas-tight, heat and vibration resistant electrical connections thus interconnecting the associated conductors of the pair of flat cables.

It is desired to provide a method for interconnecting especially dual conductor flat power cables by forming cable taps and splices.

It is also desired that such interconnection be relatively simple and provide for assured electrical connections which remain gas-tight and heat and vibration resistant over time.

It is further desired that connectors for such tap and splice interconnections be compact, comprise relatively few parts and be relatively easy to assemble.

SUMMARY OF THE INVENTION

The present invention provides for the electrical interconnection of one dual (or single) conductor flat power cable to another, forming a splice or a tap interconnection between the cables which mechanically joins the cables and electrically interconnects the respective ones of the pairs of cable conductors (or the single conductors to each other). In a first method, the cables are first prepared by punching a longitudinal slot along the medial strip (or center) of each cable at the desired interconnection site therealong; the cables are then stacked with the slots aligned and the associated conductors to be interconnected being adjacent each other in pairs. Two pairs of upper and lower wave shape structures are then aligned vertically with the respective associated pairs of conductors, the upper structures being aligned with the associated lower structures and the pairs being spaced from each other at the vicinity of the cable slot. The spaced-apart pairs of upper and lower wave shape structures are pressed together into the cable portion therebetween, shearing strips of the conductors to be interconnected and pressing alternating ones of the strips above and below the planes of the cables and exposing newly sheared conductor edges to be electrically interconnected by metal of the structures. Alternatively the wave shape structures would press previously tool-sheared conductor strips out of the cable planes.

Each wave crimp structure may comprise an adapter member and an insert member. The adapter member is disposed immediately against the insulated major cable surface, while an associated insert member is secured along the cable-remote surface of the adapter member. Each adapter member includes an array of wave shapes extending toward the cable surface and defining shearing members, alternating with arcuate shapes extending away from the cable surface defining relief recesses to receive thereinto the wave shapes of the opposing adapter member and the conductor strips pressed outwardly thereby upon shearing during the interconnection process. Each insert member is of low resistance metal such as copper and is secured to the cable-remote surface of the associated adapter member, and has an adapter-facing surface conforming closely to the cable-remote adapter surface and including corresponding wave shapes between which are relief apertures in which the arcuate relief shapes of the associated adapter member are disposed.

Upon cable interconnection, when the upper and lower structures of each pair are pressed together, the adapter wave shapes will shear the cables (unless the cables are previously sheared) and press the sheared conductor strips into the opposing relief recesses of the opposing adapter and also into the insert relief apertures in which the opposing arcuate relief shapes are disposed. The side walls of the relief apertures will thus be disposed adjacent the sheared conductor edges and also the side edges of the wave shape of the opposing adapter member, defining interlocking wave joints. Preferably the wave joints are split by being struck by blades of an apparatus extending through the relief apertures of the inserts; then the outwardly facing surfaces of the inserts are staked at the wave locations to deform the low resistance metal laterally outwardly and tightly against the adjacent sheared edges of the conductor strips forming gas-tight and heat and vibration resistant electrical connections therewith, as disclosed in U.S. Pat. No. 4,859,204. The wave splitting and insert staking may optionally be performed simultaneously. The completed interconnections of the pairs of conductors by the pairs of structures at the interconnection site are then preferably placed within housing means such as a pair of housing covers secured together, providing protection of the terminations and also providing insulative structure around all exposed conductive surfaces to prevent inadvertent engagement therewith by other articles. The housing also preferably includes internal wall sections extending between the pairs of wave crimp structures and through the longitudinal cable slots to assure insulation between exposed metal of the interconnectors and the cable conductors, thus assuring that the interconnections remain assuredly isolated from each other.

In a second method, the cables need not be prepunched. The two upper structures are initially integrally joined by a spaced pair of ligatures of their adapter members extending across a medial region between the separate insert members, as are the two lower structures, which reduces by half the number of separate parts and simplifies handling, alignment and assembly. After being compressed together onto the pair of cables at the interconnection site, tooling of the apparatus punches the slots through the cables and simultaneously shears away the ligatures of both the upper and lower joined structures, thus separating and electrically isolating the cable-applied upper and lower structures into separate interconnecting structures, after which wave splitting and insert staking is performed as before.

Each wave crimp structure of the present invention may include integral means to lock the upper and associated lower structures of each pair together after cable interconnection. As set forth in U. S. Patent application Ser. No. 07/454,553 filed Dec. 21, 1989 in one embodiment the inserts have defined adjacent at least one of the relief apertures a pocket extending laterally therefrom, into which metal of an adjacent wave shape of the adapter of the opposing wave crimp structure will be deformed during the staking process, thus locking the structures together and providing mechanical integrity to the interconnection without the need of riveted lateral flanges as in U.S. Pat. No. 4,900,650. In another embodiment the adapters have tabs to extend through corresponding recesses of the opposing adapters after which the tabs are bent over to lock behind the adapter of the opposing structure, thus locking the structures to each other about the cables.

It is an objective of the present invention to provide a connector for a splice or tap interconnection of dual (or single) conductor flat power cables which comprises a gas-tight, heat resistant and vibration resistant interconnection therebetween, which retains the circuits assuredly discrete.

It is another objective to provide a connector having a minimal number of separate parts and is relatively easy to assemble, requiring minimal cable preparation.

It is yet another objective to provide such a splice or tap interconnection which defines a compact envelope upon completion, having minimal height, width and length.

It is still another objective to provide such a splice or tap interconnection which compensates for at least a limited range of cable thicknesses.

Embodiments of the present invention will now be discussed with reference to the accompanying drawings.

DETAILED DESCRIPTION OF THE PREFERRED EMBODIMENTS

Figure 1:
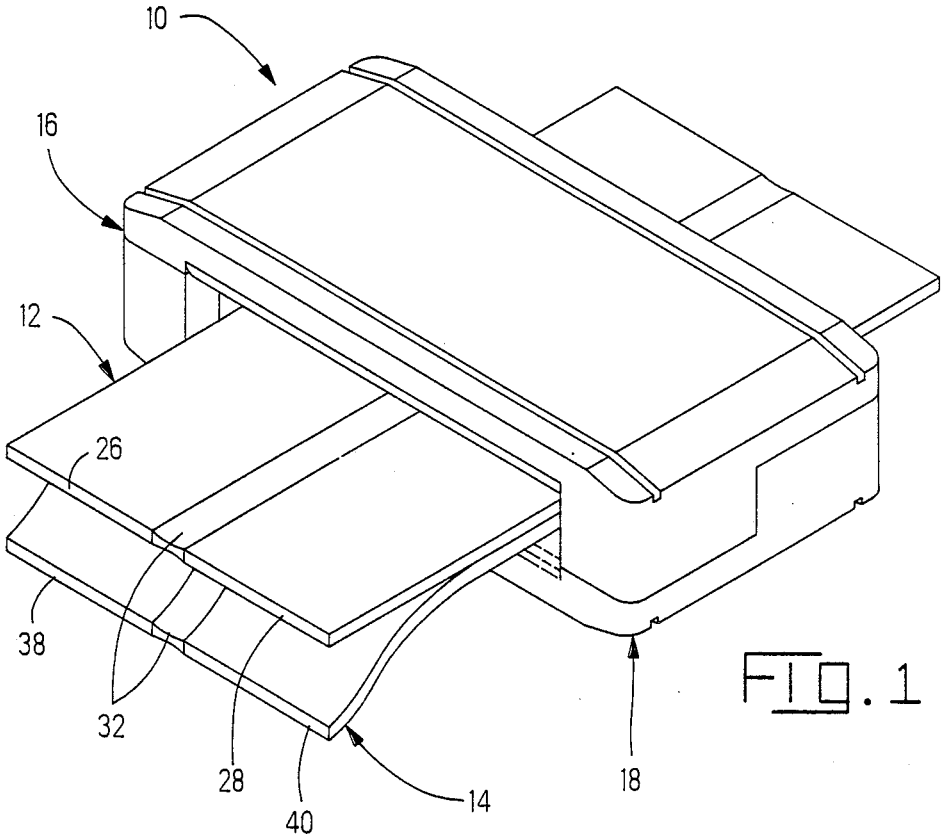
FIG. 1 is a perspective view of a completed, housed in-line tap connection between a main dual conductor flat power cable and a tap cable.
Figure 1A:
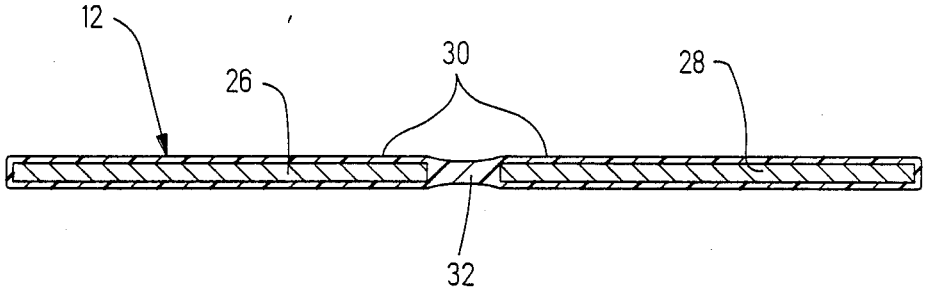
FIG. 1A is a cross-section of a dual conductor flat power cable of the type being interconnected.
Figure 2:
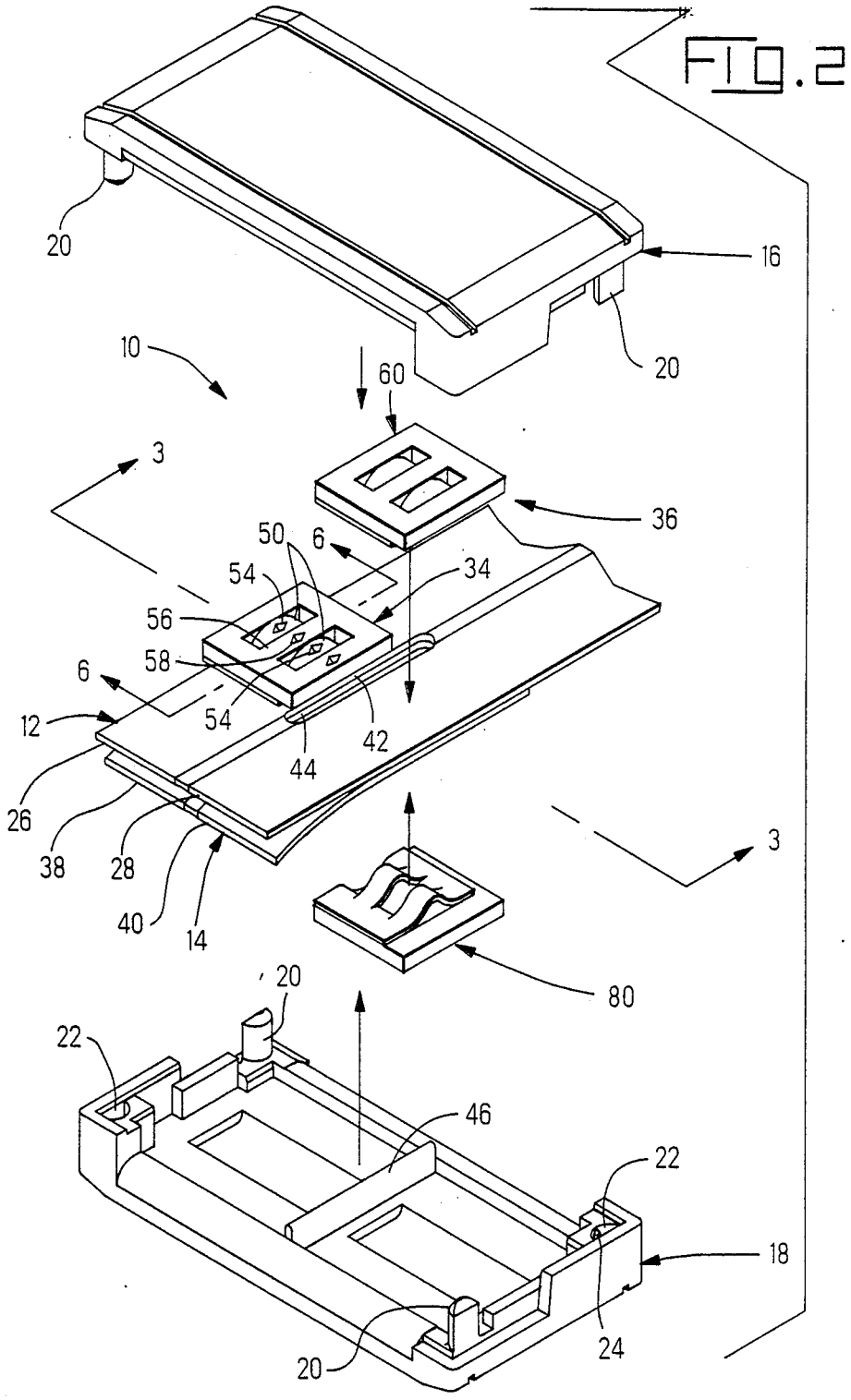
FIG. 2 is a perspective view of the tap connection of FIG. 1 with the housing members exploded from the tap connection, revealing one interconnecting structure of one embodiment of the present invention terminated to and interconnecting a respective pair of conductors of the main and tap cables after staking, and upper and lower members of another like structure about to be terminated to the other pair of cable conductors.
Figure 11A:
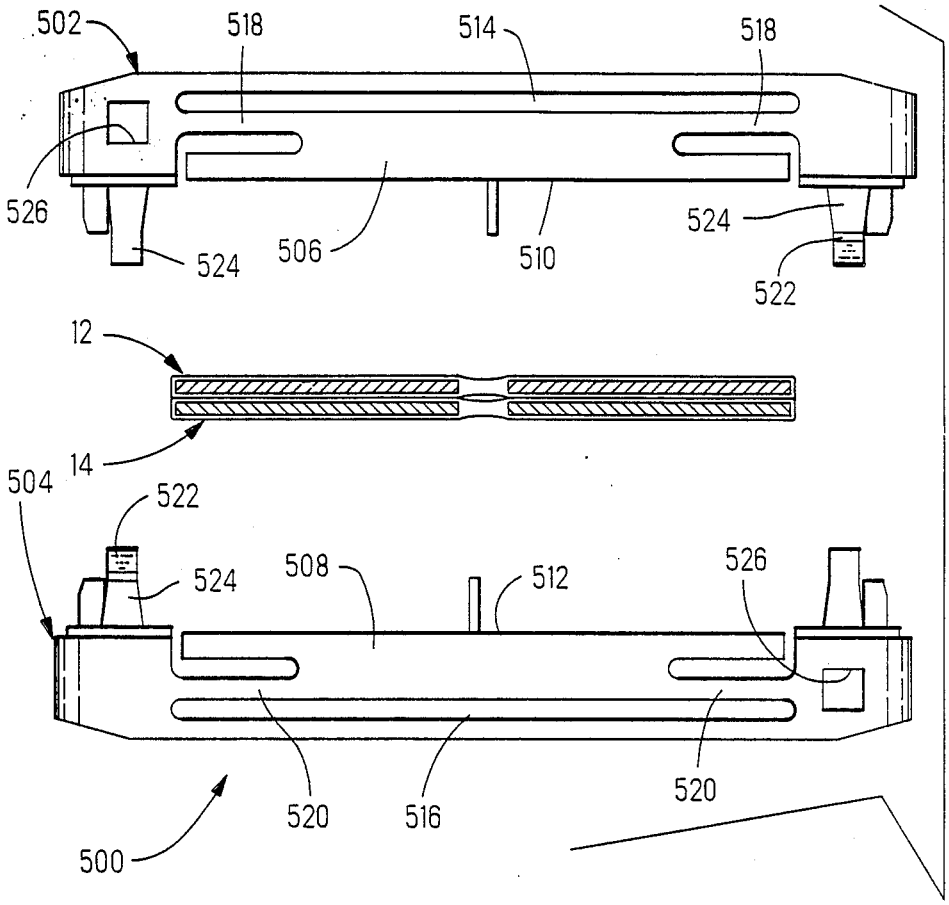
FIGS. 11A and 11B are end views of another embodiment of housing members before and after being secured together about the cable interconnection site.
Figure 11B:
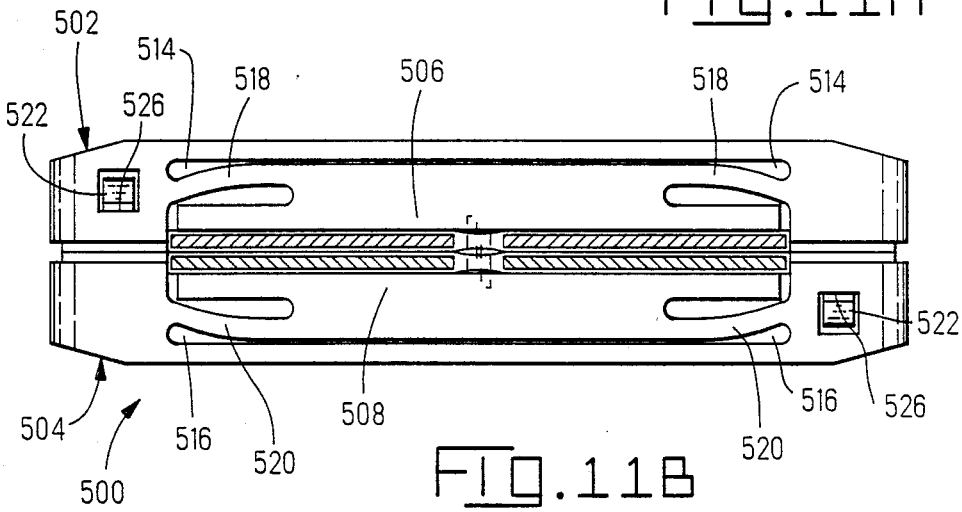

FIGS. 1 and 2 illustrate an interconnection of a first flat power cable with a second such cable, which may be single or dual conductor; the interconnection shown is a tap connection 10 between a main dual conductor flat cable 12 and a tap cable 14 of similar construction. The interconnection of the present invention may also be used to splice together a pair of flat cables. The housing assembly can comprise dielectric upper and lower housing members 16,18 which are secured together to at least provide insulation and physical protection of the cable interconnection site. Members 16,18 are shown being hermaphroditic and securable together by semicylindrical posts 20 at diagonally opposed corners force-fittable into corresponding semicylindrical apertures 22 of the other housing member, where apertures 22 include engaging ribs 24 protruding radially into the apertures which become plastically deformed to firmly hold the posts in the apertures, as disclosed in U.S. Pat. No. 4,781,615. Housing members 16,18 may be molded for example of thermoplastic resin having heat resistant properties such as VALOX DR 48 resin sold by General Electric Company, Fairfield, Conn., or CELANEX 3112-2 ED 3002 polyester resin sold by Celanese Plastics & Specialties Company, Chatham, N.J. (Alternatively, housing members 16,18 may be securable together by means of latches as shown in FIGS. 11A and 11B.)

FIG. IA illustrates a typical cross-section of a dual conductor flat power cable 12 wherein a pair of flat conductors 26,28 have an insulative coating 30 extruded therearound and defining a medial strip 32 between the conductors; cable 14 has identical construction. While the present disclosure is shown and described with respect to dual conductor cables, it is easily seen that the same terminal and methods are usable with single conductor cables.

Figure 7:
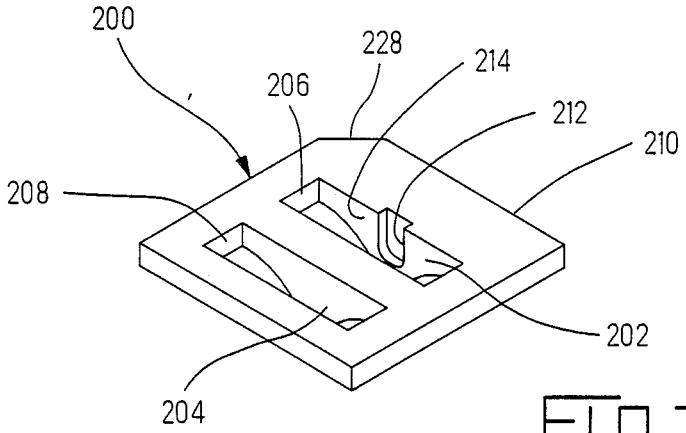
FIG. 7 is an enlarged perspective view of one embodiment of insert of an interconnecting structure having a pocket along a side wall of a relief aperture used to generate a lock upon staking for enhanced mechanical securing of the upper and lower interconnecting structures to each other and to the cables.
Figure 8C:
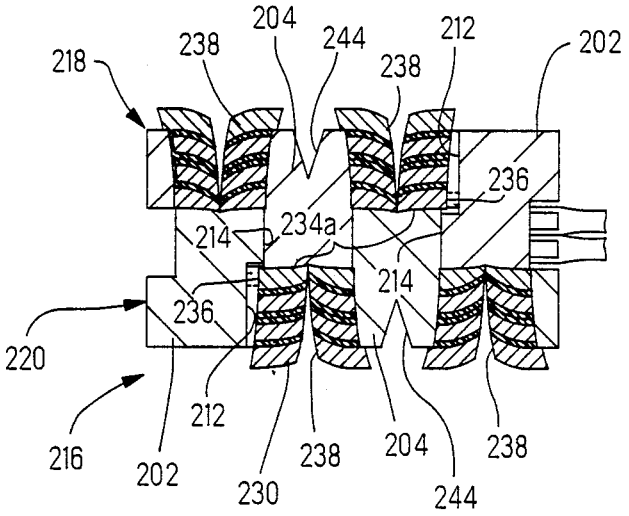
FIGS. 8A, 8B and 8C are cross-sectional views of upper and lower interconnecting structures having the insert of FIG. 7 upon being terminated to the cables, prior to application, before and after staking respectively.
Figure 8A:
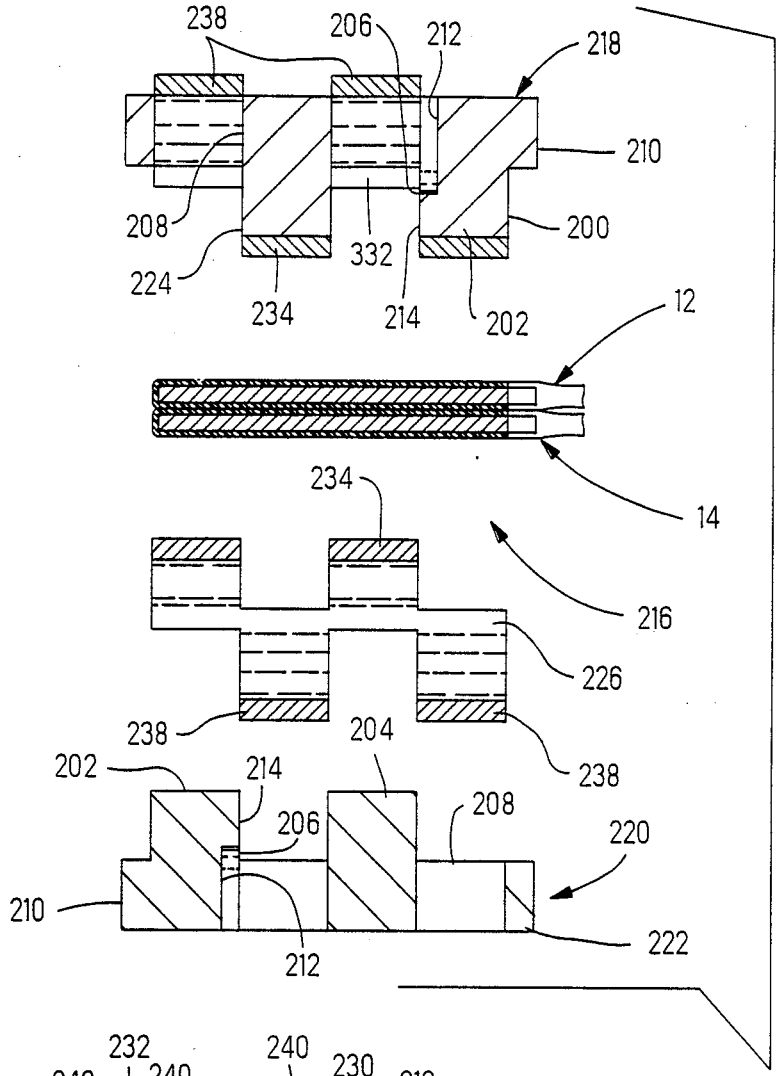
Figure 8B:
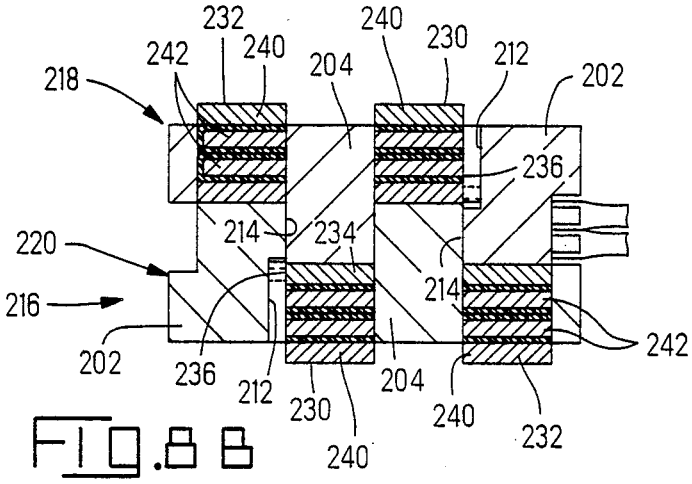
Figure 9A:
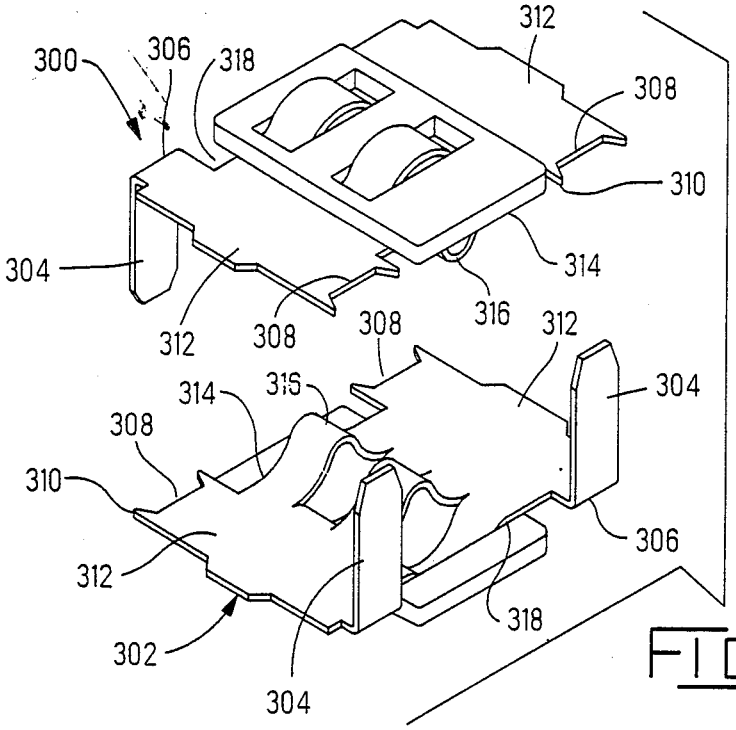
FIGS. 9A and 9B are perspective views of upper and lower interconnecting structures having an embodiment of adapters for providing mechanical securing to themselves and to the cables, before and after termination to the cables.
Figure 9B:
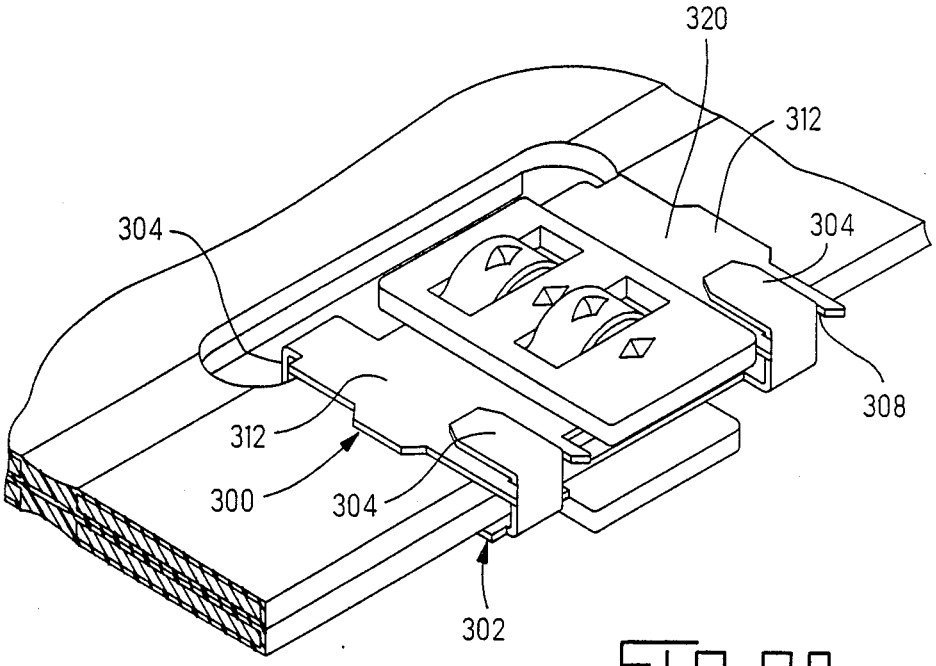

A first method of interconnection is shown and described in FIGS. 2 to 8C while a second method is shown in FIGS. 9A to 9C. In FIG. 2 two interconnecting structure assemblies 34,36 are shown each of which interconnects respective ones of the conductors of the main and tap cables, while sandwiching both cables therewithin. Assembly 34 electrically interconnects conductor 26 of main cable 12 with conductor 38 of tap cable 14. Assembly 36 will electrically interconnect conductors 28,40 when pressed together against the cables. Cables 12,14 are previously prepared for termination by having punched therethrough vertically aligned elongate slots 42,44 therethrough along the medial strips thereof, removing at least most of the width of the medial strips. Medial slots 42,44 permit an axially extending barrier wall 46 of the housing members 16,18 to extend therethrough providing dielectric material between the interconnecting structures 34,36 after termination to assure electrical isolation of the circuits after interconnection. Barrier wall 46 may comprise respective wall sections of both members 16,18 slightly offset from center to permit passing by each other during assembly of housing members 16,18 about the interconnection site. Slots 42,44 also enable registration tooling of the termination apparatus (not shown) to accurately locate and hold the cables in position during termination. The interconnections occur at sides of each of a plurality of alternating upper and lower wave joints, upper wave joints 50 being visible in the Figure.

Figure 3:
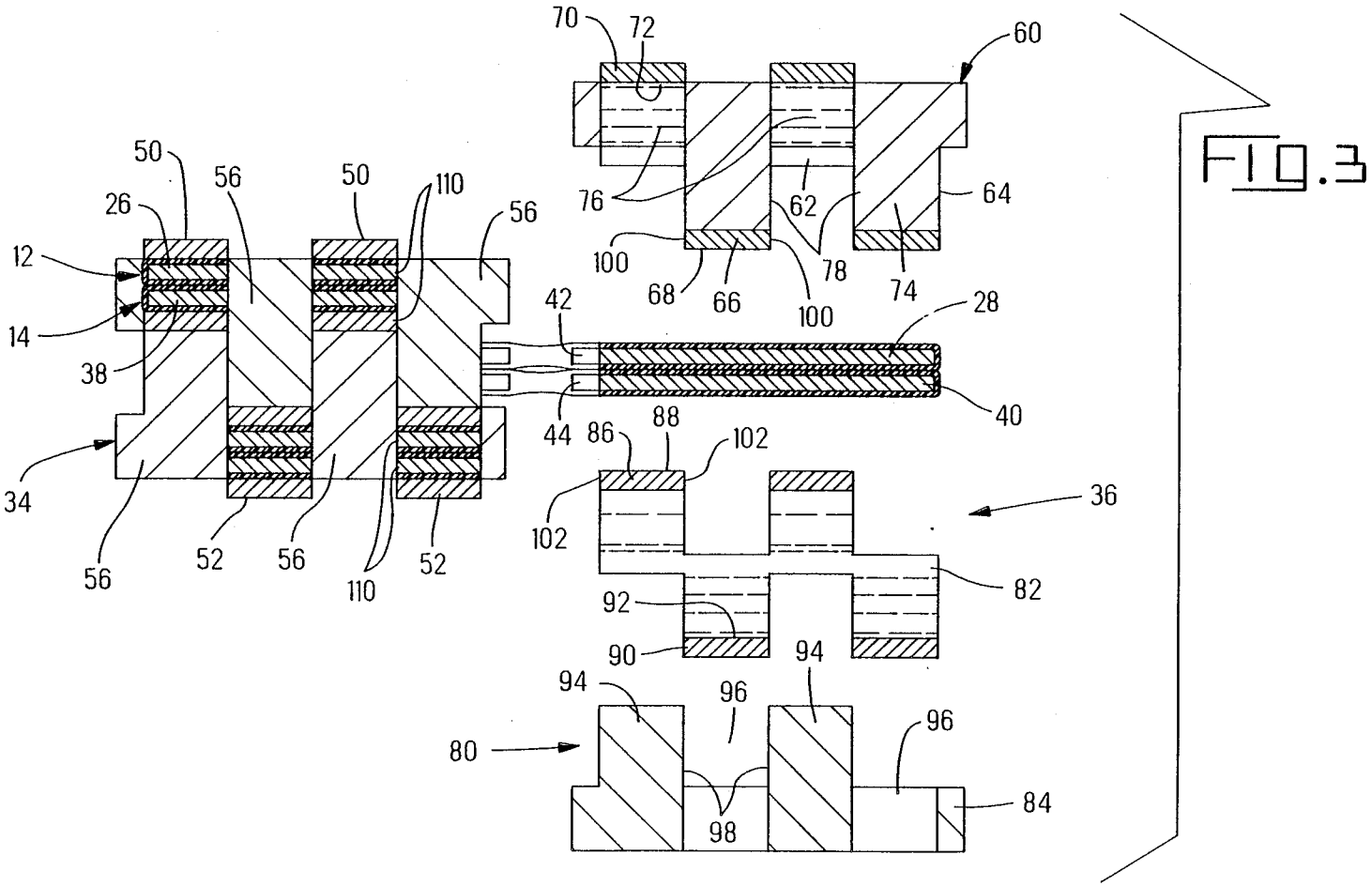
FIG. 3 is a cross-sectional view across the cables taken generally along lines 3—3 of FIG. 2, showing the array of wave joints interconnecting the conductors of the left side of the main and tap cables, and showing the upper and lower structures of the present invention on the right.

FIG. 3 represents a simplified cross-section through interconnecting structure assembly 34, showing the plurality of upper wave joints 50 alternating and interlocking with lower wave joints 52. Wave joints 50,52 are similar to the type disclosed in U.S. Pat. Nos. 4,859,204 and 4,867,700 which are incorporated herein by reference. Each wave joint 50,52 is preferably split axially as depicted at 54 in FIG. 2 by a staking process which strengthens the joint. Across from and between the upper wave joints 50,52 are sections of bulk metal 56 of structure assembly 34 which sections are staked as depicted at 58 of FIG. 2 which deforms the bulk metal laterally tightly against the sheared edges of the conductors 26,38 forming gas-tight joints therewith; the prior splitting of the wave joints at 54 imparts strong but compliant resistance to the staking of the bulk metal sections and also provides stored energy in the joint which helps maintain the gas-tight nature of the interconnections during in-service use which commonly involves elevated temperatures and vibration. After interconnection and during in-service use, adapter members 62,82 (FIG. 4) assist in confining the relatively yielding conductors 26,38 thereby inhibiting stress relaxation which otherwise would reduce stored energy in wave joints 50,52.

Referring to FIGS. 3 through 6, upper interconnecting structure 60 is comprised of an upper transition adapter member 62 and an upper insert member 64, while lower interconnecting structure 80 is comprised of a lower transition adapter member 82 and a lower insert member 84. Adapter members 62,82 may be stamped and formed for example from a sheet of Olin Copper Alloy 197 in half hard temper about 0.025 inches thick which is nickel underplated and silver plated, preferably, and treated for tarnish resistance. Insert members 64,84 may be for example of dead soft Copper CDA 110 generally about 0.066 inches thick which is nickel underplated and silver plated, preferably, and treated for tarnish resistance. Adapter members 62,82 are designed to be hermaphroditic, as are insert members 64,84 and also housing members 16,18, thus simplifying inventory and assembly by requiring fewer different parts to establish the tap or splice connector 10. The interconnection regions of the upper and lower assemblies 34,36 are preferably intermatable with each other when opposed, with the wave shapes precisely offset and opposed from relief recesses when applied to the cables. Preferably each insert member is secured to its associated adapter member to be easily handled as a unit; such securing may be by force-fitting of the arcuate adapter relief shapes within the insert relief apertures; alternatively the inserts may be slightly prestaked as disclosed in U.S. Pat. No. 4,859,204.

The interconnection region of upper adapter 62 includes a pair of downwardly protruding wave shapes 66 each including a wave crest 68, alternating with a pair of upwardly directed arcuate shapes 70 having widths identical to the width of a wave shape 66 and defining relief recesses 72. The array of wave crests 68 and alternating relief recesses 72 is to be oriented transversely with respect to the cables. The interconnection region of lower adapter member 82 is similar to upper adapter 62 but is configured to cooperate with upper adapter 62; lower adapter 82 includes a pair of upwardly protruding wave shapes 86 each including a wave crest 88, alternating with a pair of downwardly directed arcuate shapes 90 having widths identical to the width of a wave shape 86 and defining relief recesses 92. Each wave shape 66,86 is defined between a pair of parallel vertical side edges 100,102 extending axially with respect to the cable. Together edges 100,102 will cooperate during termination to comprise shearing edges to shear the cable conductors during termination, if the cables have not been previously tool sheared.

Figure 4:
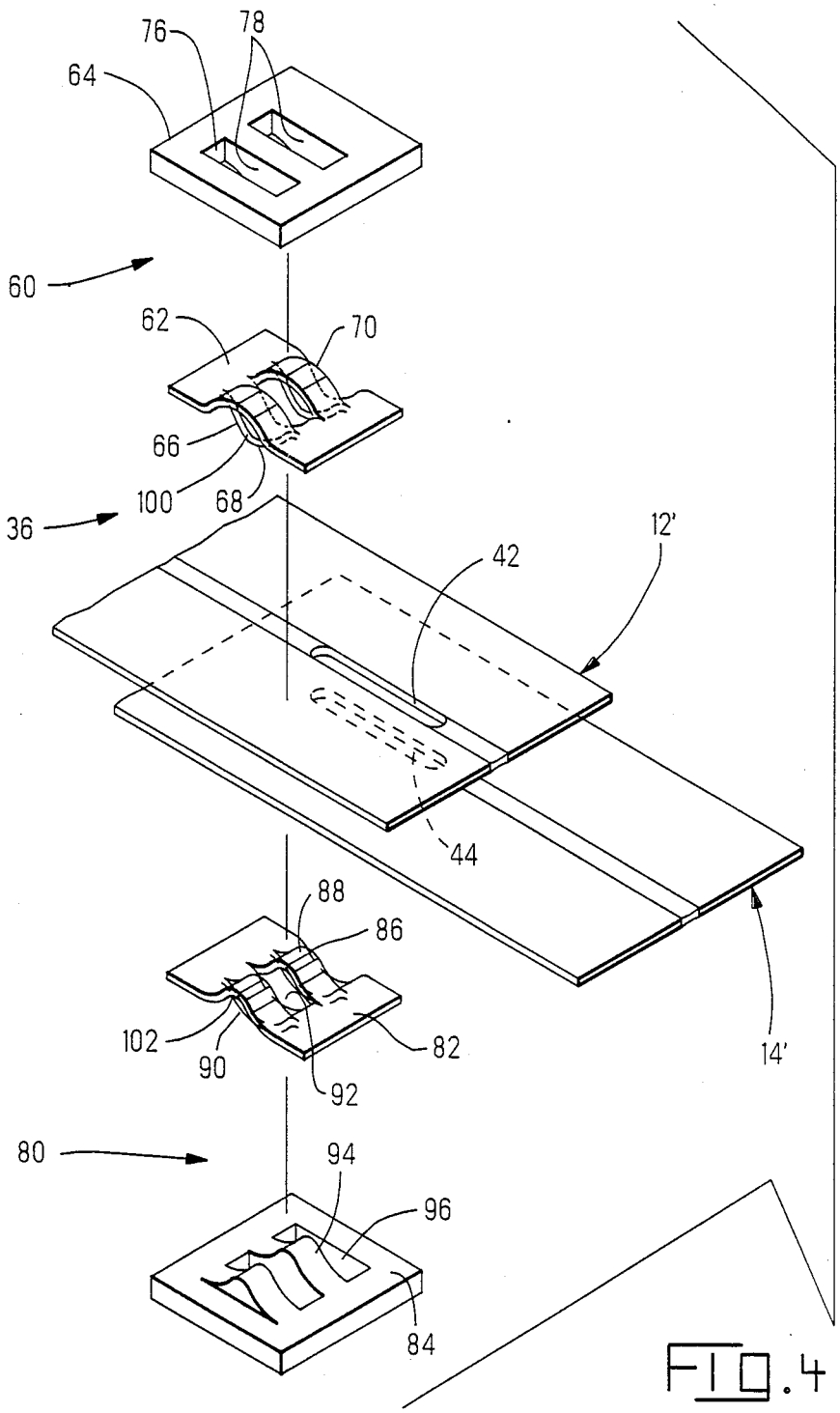
FIG. 4 is a perspective view of the adapter members and insert members of the upper and lower interconnecting structures.

Upper insert member 64 includes an adapter-proximate surface which will be disposed against the cable-remote surface of upper adapter 62, and is shaped to conform closely therewith. Upper insert 64 includes a pair of wave shapes 74 separated by one of apertures 76 and having vertical side walls 78, with wave shapes 74 corresponding with wave shapes 66 of adapter 62 and apertures 76 receiving arcuate shapes 70 thereinto. Likewise lower insert member 84 includes a pair of wave shapes 94 separated by one of a pair of apertures 96 and having vertical side walls 98, with apertures 96 receiving thereinto arcuate shapes 90. In FIG. 4 is seen a pair of cables 12',14' being spliced, identical in structure to cables 12 and 14.

Figure 6:
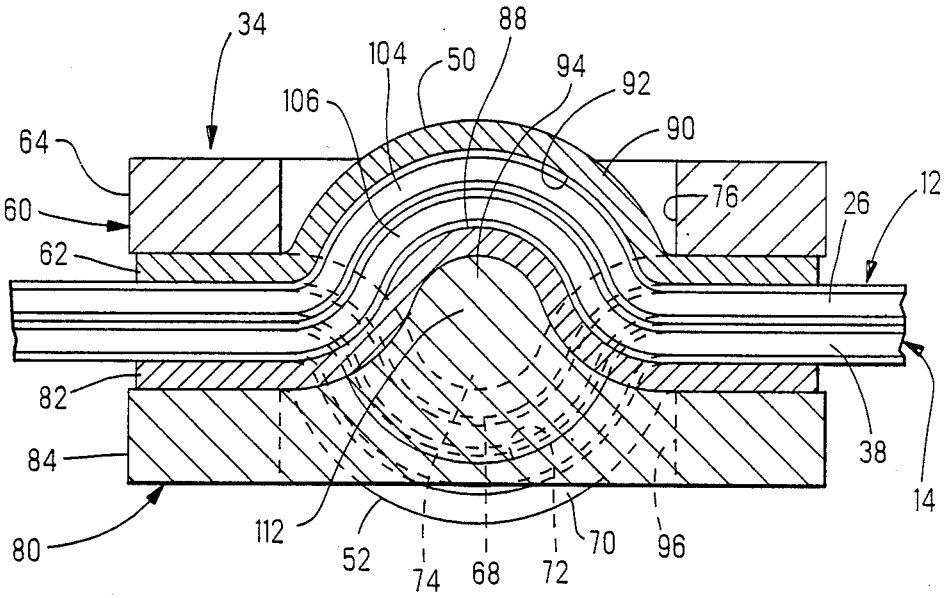
FIG. 6 is a longitudinal section view through a wave joint and generally along lines 6—6 of FIG. 2 showing the wave joint formed by an interconnecting structure of FIG. 5 upon termination.

FIG. 6 illustrates the structure of a wave joint 50, and also of a lower wave joint 52 (in phantom), after termination of upper and lower interconnecting structures to main and tap cables 12,14. Side edges 100,102 of wave shapes 66,86 have sheared conductors 26,38 into strips 104,106 and wave shapes 66,86 have pressed the sheared conductor strips into the opposing relief recesses 72,92 respectively within apertures 76,96. The wave crests 68,88 have been designed and dimensioned with respect to the nominal cable thicknesses so that the newly sheared edges 110 (see FIG. 3) of the sheared conductor strips are moved past the vertical side edges of the wave shapes of the opposing wave shapes and past substantial vertical areas of the side surfaces of the wave shapes of the opposing inserts. This is indicated in FIG. 6 by the wave overlap area 112, and is best seen in FIG. 3 where newly sheared conductor edges 110 can best be identified. Especially after wave joint splitting and insert wave staking as in FIG. 2 at 54 and 58 by blades of the terminating apparatus (not shown) after the shearing and pressing of the conductor strips out of the cable plane has occurred, as taught in U.S. Pat. No. 4,859,204, assured gas-tight connections are formed between sheared conductor edges 110 and both the metal comprising the side walls 78,98 of insert apertures 76,96 and wave shapes 74,94 and the metal comprising the side edges 100,102 of the adapter wave shapes 66,86 at a plurality of locations across the terminating region, interconnecting the conductors 26,38 of the main and tap cables 12,14. Alternatively, the cables can be sheared by tooling at locations corresponding to wave shape edges to define the conductor strips which may then be pressed out of the plane of the cable by the adapter wave shapes for the previously sheared conductor edges to be disposed adjacent the metal side edges of the adapter wave shapes and the side walls of the insert wave shapes.

The interconnecting structures are preferably adapted to provide a positive self-locking means after termination, whereby the upper and lower assemblies positively lock to each other thus securing themselves tightly to each other with the cable portions clamped therebetween; the mechanical fastening attained by the self-locking means thus protects the terminations and their gas-tight interconnections against strain and vibration. FIGS. 7 to 9B illustrate several examples of such self-locking means. In FIGS. 7 to 8B the inserts are adapted to provide for metal of the opposing adapter waves to be deformed laterally thereinto during the wave splitting procedure, as set forth in Serial No. 07/454,553. In FIGS. 9A and 9B the adapters are provided with tabs which extend through recesses in the opposing adapter to be bent over and against the far side of the opposing adapter.

Figure 5:
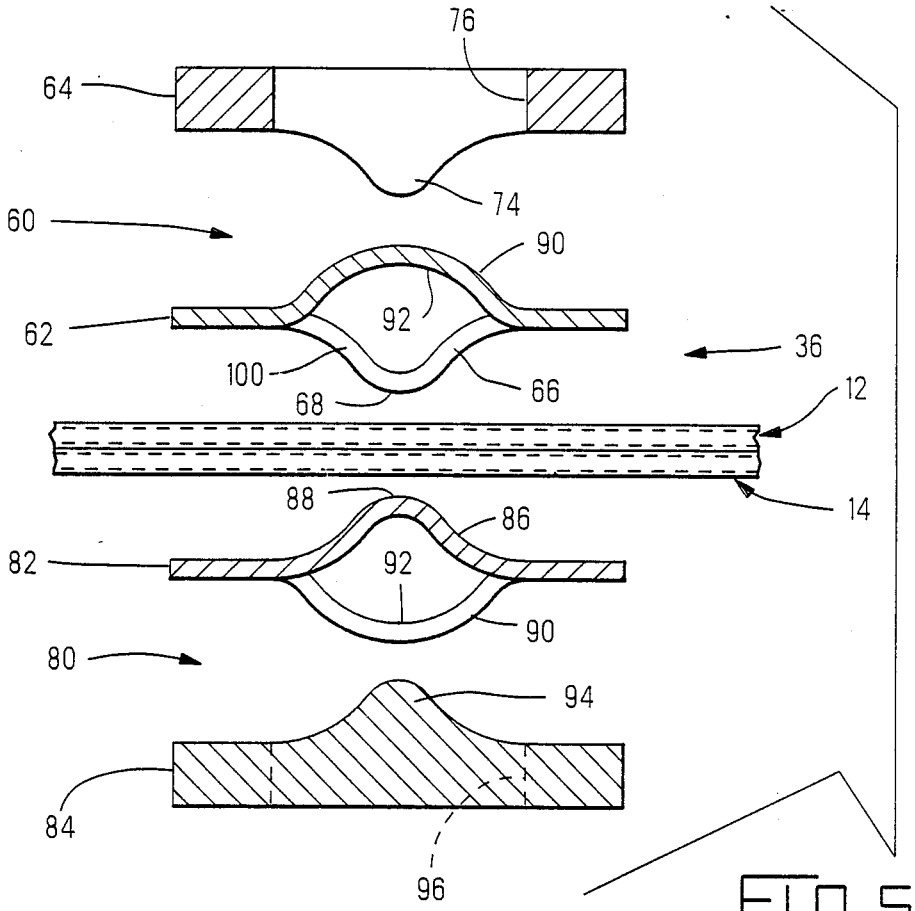
FIG. 5 is a longitudinal section view through an interconnection site showing upper and lower adapter and insert members exploded from the two cables.

In FIGS. 7 and 8A an insert 200 similar to insert 64 of FIG. 5 includes a pair of insert wave shapes 202,204 alternating with a pair of apertures 206,208. Wave shape 202 is disposed closer to a lateral edge 210 of insert 200 and includes a pocket 212 of narrow width extending along vertical side wall 214 almost to the surface of the crest of the wave. Electrical interconnection 216 of FIG. 8A uses upper and lower assemblies 218,220 which utilize a pair of inserts 200,222 with adapters 224,226 identical to adapters 62,82 of FIG. 5. Also shown in FIG. 7 is a chamfered corner 228 which provides a means for locating and orienting the insert in the application tooling along with a corresponding chamfer on the associated adapter to which it is secured, for assuring the appropriate precise alignment of the upper and lower assemblies of each interconnecting structure.

In FIG. 8B it can be seen that each of pocket-adjacent and pocket-remote wave joints 230,232 of interconnection 216 extends deeply enough into the relief aperture 206,208 of the far insert for the wave crest 234 of wave joints 230 to be located within apertures 206, with side edges 236 thereof of the to be adjacent a pocket 212 in the vertical side wall 214 of the adjacent wave shape 202 of the respective far insert. In FIG. 8C the waves 230,232 are split at 238 by staking tooling (not shown) as in U.S. Pat. No. 4,859,204, to a greater depth inwardly from the blade-receiving surface of the arcuate relief shapes 240 in order to split the entire wave joint to assure splitting pocket-adjacent wave crests 234 to be split and the split portions 234*a* forced laterally in the same manner that the conductor strips 242 are split and the split portions forced laterally. A portion of wave crest 234 adjacent pocket 212 of the insert of the opposing assembly is deformed into pocket 212, defining a lock to hold the completed, staked interconnection 216 together after the remaining insert staking is performed as described with respect to FIG. 2. With one of the upper and lower assemblies having the pocket near the outside cable edge and the other having its pocket near the cable slot, interconnection 216 is self-locked along both sides thereof. Additional insert staking at 244 preferably is preformed remote from pockets 212.

Referring to FIGS. 9A and 9B, another embodiment of adapter members 300,302 is shown which provides for the adapters to lock to themselves after termination. Adapter members 300,302 are actually identical in a reverse opposing orientation thereby being hermaphroditic. Each has a pair of tab sections 304 along one common lateral side 306 and a pair of tab-receiving recesses 308 along the other common lateral side 310, all disposed on respective end sections 312 extending axially from interconnection region 314 which contains an array of wave shapes 316 alternating with arcuate shapes 318 defining relief recesses. In FIG. 9B interconnection 320 has been locked together after tab sections 304 of each of adapter members 300,302 have extended past inside and outside cable edges and through associated recesses 308, after which tab sections 304 have been bent over firmly against the outer surfaces of sections 312 of the opposed adapter member 302,300. The array of wave shapes and relief recesses are configured to be intermatable when the wave shapes oppose relief recesses, when the adapter members are opposed and aligned for cable application.

Figure 10A:
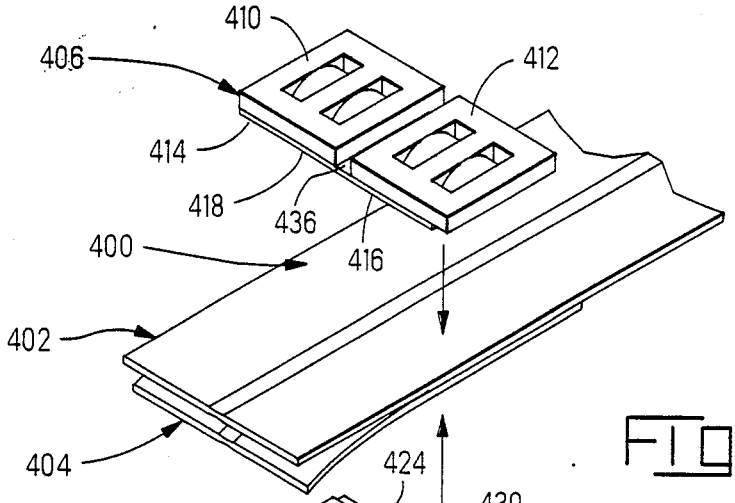
FIGS. 10A, 10B and 10C are perspective views illustrating another method of interconnecting cables, wherein the upper structures are initially joined by ligatures, and the lower structures also initially joined, before and after application to the cables, after which the ligatures are sheared away and the medial slots punched through the cables.
Figure 10B:
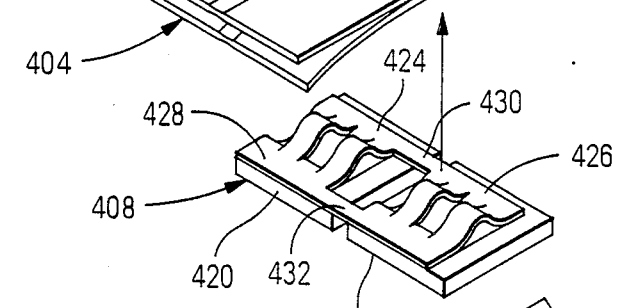
Figure 10B:
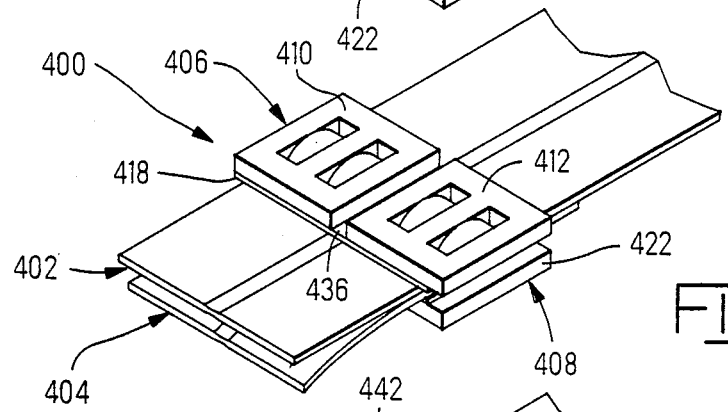
Figure 10C:
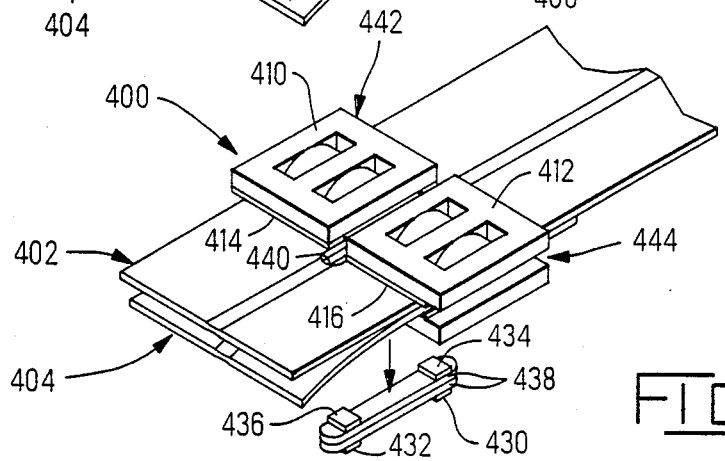

A second method of performing the tap or splice interconnection of the present invention, is illustrated in FIGS. 10A to 10C. In FIG. 10A, cables 402,404 at interconnection site 400 need not be prepunched, and upper structure 406 and lower structure 408 extend transversely the full width of the cables. Upper structure 406 includes a pair of upper inserts 410,412 secured to respective sections 414,416 of a single upper adapter member 418. Similarly a pair of lower inserts 420,422 are secured to respective sections 424,426 of a single lower adapter member 428. As seen with respect to lower adapter member 428, its sections 424,426 are initially joined together by a spaced apart pair of ligatures 430,432; upper adapter member 418 is similarly constructed, having ligatures 434,436. In FIG. 10B, upper and lower structures remain intact during application to cables 402,404 thus simplifying handling, alignment and assembly. In FIG. 10C, tooling of the termination apparatus (not shown) strikes along the medial strip of the cables between upper inserts 410,412 and lower inserts 420,422 and simultaneously shears away ligatures 430,432,434,436 and also punch out medial cable sections 438 defining axially extending slots 440 through which wall sections of the housing members may extend. Removal of the ligatures thus physically and electrically separates and defines laterally spaced interconnecting structures 442,444 joining associated conductors of cables 402,404. Then upon wave splitting and insert staking the termination will be assuredly complete as in FIG. 8C.

Another embodiment of housing members 502,504 is shown in FIGS. 11A and 11B being assembled together to enclose a terminated interconnection site 500. Housings 502,504 are disclosed in U.S. Patent application Ser. No. 07/454,259 filed Dec. 21, 1989 and assigned to the assignee hereof. Cable-engaging sections 506,508 abut the adjacent outwardly facing surfaces of the cable or cables 12,14 exiting from the ends of the interconnection site 500. Cable-engaging sections 506,508 are stiffly resilient spring biased clamps firmly holding cable or cables 12,14 therebetween: cable-engaging platforms 510,512 are deflectable upon clamping into transverse relief slots 514,516 therebehind and remain integrally joined to housing members 502,504 by hinges 518,520 which are elastically deformable. Housing members 502,504 are secured together by latching projections 522 of latch arms 524 at diagonal corners of each housing latchable with corresponding latching recesses 526 of the other housing. In this manner housing members 502,504 of tap connection 10 of the present invention may compensate for one cable thickness or two cable thicknesses, and also for a range of cable thicknesses of from 0.014 to 0.034 inches and still attain cable clamping for vibration resistance and strain relief benefits.

The splice and tap connector of the present invention can be modified and varied as exemplified by the several embodiments of the various few parts of the connector contained herein. Such modified and varied connectors and components thereof are within the spirit of the invention and the scope of the claims.

What is claimed is:

1. An interconnection of two flat power cables each having at least one flat conductor therein, comprising:

a first flat power cable having at least one flat conductor therein, and a second flat power cable having a corresponding at least one flat conductor therein;

at least one interconnecting structure assembly corresponding to each said at least one conductor, each said assembly having an upper structure and a lower structure joined together with selected sections of said first and second cables disposed therebetween, each said assembly having an interconnection region including a plurality of wave shapes alternating with relief recesses along a cable-proximate surface of said upper structure, and a cooperating plurality of wave shapes and alternating relief recesses along a cable-proximate surface of said lower structure, each said wave shape being opposed by a said relief recess, and said wave shapes of said upper and lower structures being adapted to at least press associated overlying sheared conductor strips of identical width into said opposing relief recesses so that edges of said conductor strips are disposed against metal surfaces defining side edges of adjacent ones of said wave shapes for electrical connection therewith; and each said upper and associated lower assembly having a width to extend transversely across less than one-half the width of a said cable from an associated side edge thereof, such that the said interconnecting structures can be associated with a respective lateral portion of said cables and be positioned aligned transversely across the cable spaced from each other for electrical circuit isolation, to minimize the axial length of the resulting interconnection and be enclosed within housing means of corresponding minimal axial length.

2. An interconnection as set forth in claim 1 wherein said interconnection regions of each of said upper and lower structures are intermatable when opposed and aligned with wave shapes of one opposing relief recesses of the other, whereby said structures are identical and hermaphroditic.

3. An interconnection as set forth in claim 1 wherein each said upper and lower structure includes a pair of wave shapes alternating with a pair of relief recesses of equal width adapted to receive thereinto a pair of wave shapes of the opposing one of said upper and lower structure and conductor strips pressed out of the cable plane thereby upon termination.

4. An interconnection as set forth in claim 1 wherein each said upper and lower structure includes an adapter member disposed adjacent a major surface of one of said first and second cables, and an insert member disposed securely along a cable-remote surface of a respective said adapter member, wherein said insert members provide a substantial portion of the electrical engagement surface adjacent said edges of said conductor strips.

5. An interconnection as set forth in claim 1 wherein each of said first and second cables includes first and second flat conductors spaced from each other by a medial strip of insulative material, said first conductors interconnected together by a first said interconnecting structure assembly and said second conductors interconnected together by a second said interconnecting structure assembly.

6. An interconnection as set forth in claim 1 wherein said selected section of one of said first and second cables is an end section, and said interconnection defines a tap connection of a tap cable to a main cable.

7. An interconnection as set forth in claim 1 further including housing means enclosing said interconnection.

8. An interconnection as set forth in claim 7 wherein said housing means comprises a pair of housing covers self-securable together about said interconnection.

9. An interconnection as set forth in claim 7 wherein said housing means includes resilient cable-clamping means for firmly clamping major side surfaces of each at least one said first and second cables extending from said interconnection, providing assured insulation at the cable exits of the interconnection and vibration resistance for at least a limited range of cable thicknesses at said cable exits.

10. An interconnection as set forth in claim 1 wherein said cables include respective medial slots vertically aligned upon stacking prior to termination, and said interconnecting structure assemblies are terminated on respective sides of said medial slots.

11. An interconnection as set forth in claim 10 further including housing means enclosing said interconnection.

12. An interconnection as set forth in claim 11 wherein said housing means includes dielectric structure extending vertically through said aligned medial slots and between said interconnecting structure assemblies.

13. An assembly for interconnecting first and second flat power cables each having at least one flat conductor therein, comprising:

at least one interconnecting structure assembly corresponding to each said at least one conductor, each said assembly having an upper structure and a lower structure adapted to be matable therewith to be joined together upon application to said first and second cables with selected sections of said first and second cables disposed therebetween, each said assembly having an interconnection region including a plurality of wave shapes alternating with relief recesses along a cable-proximate surface of said upper structure, and a cooperating plurality of wave shapes and alternating relief recesses along a cable-proximate surface of said lower structure, each said wave shape being opposed by a said relief recess, and said wave shapes of said upper and lower structures being adapted to at least press associated overlying sheared conductor strips of identical width into said opposing relief recesses so that edges of said conductor strips will be disposed against metal surfaces defining side edges of adjacent ones of said wave shapes for electrical connection therewith; and each said upper and associated lower assembly having a width to extend transversely across less than one-half the width of a said cable from an associated side edge thereof, such that the said interconnecting structures can be associated with a respective lateral portion of said cables and be positioned aligned transversely across the cable spaced from each other for electrical circuit isolation, to minimize the axial length of the resulting interconnection and be enclosed within housing means of corresponding minimal axial length.

14. An assembly as set forth in claim 13 wherein said interconnection regions of each of said upper and lower structures are intermatable when opposed and aligned with wave shapes of one opposing relief recesses of the other, whereby said structures are identical and hermaphroditic.

15. An assembly as set forth in claim 13 wherein each said upper and lower structure includes a pair of wave shapes alternating with a pair of relief recesses of equal width adapted to receive thereinto a pair of wave shapes of the opposing one of said upper and lower structure and conductor strips pressed out of the cable plane thereby upon termination.

16. An assembly as set forth in claim 13 further comprising a spaced apart pair of upper insert members associated with respective lateral sides of said first and second cables, both secured to respective lateral sections of an upper adapter member, said lateral sections thereof initially joined together by ligature means associated with narrow media regions of said first and second cables, and further comprising a spaced apart pair of lower insert members associated with respective lateral sides of said first and second cables, both secured to respective lateral sections of a lower adapter member, said lateral sections thereof initially joined together by ligature means associated with narrow media regions of said first and second cables, whereby removal of said ligature means after application of said upper and lower structures to said first and second cables separates the lateral sections of said upper and lower adapter members and defines electrically isolated structures interconnecting conductor means of said first and second cables along both lateral sides thereof.

17. An assembly as set forth in claim 13 wherein each said upper and lower structure includes an adapter member disposed adjacent a major surface of one of said first and second cables, and an insert member disposed securely along a cable-remote surface of a respective said adapter member, wherein said insert members provide a substantial portion of the electrical engagement surface adjacent said edges of said conductor strips.

18. An assembly as set forth in claim 17 wherein each of said adapter members of said upper and lower structures includes at least one end section extending axially from said interconnection region thereof, said at least one end section of each said adapter member associated with and opposed from said at least one end section of the other said adapter member for application to said cables such that said associated opposed end sections are disposed against major surfaces of said first and second flat cables, one said end section including at least one tab-receiving recess along a lateral edge thereof, and the other said end section including at least one tab section extending vertically from a lateral edge thereof toward an associated said tab-receiving recess of said one end section and adapted to be received therethrough upon said adapter members being applied to said cables and thereafter be bent over against the remote surface of said one end section, securing said adapter members together and to said first and second cables.

19. An assembly as set forth in claim 18 wherein each said adapter member includes two said end sections extending axially in opposed directions from said interconnection region thereof.

20. An assembly as set forth in claim 19 wherein each said adapter member includes a pair of said tab sections along a common firs lateral edge each extending from a respective one of said end sections, and further including a pair of said tab-receiving recesses along a common second lateral edge each along a respective one of said end sections, whereby said adapter members are identical and hermaphroditic.

21. An assembly asset forth in claim 13 further including housing means enclosing said interconnection.

22. An assembly as set forth in claim 21 wherein said interconnection includes dielectric structure extending vertically through aligned medial slots of said first and second cables and between said interconnecting structure assemblies.

23. An assembly as set forth in claim 21 wherein said housing means comprises a pair of housing covers self-securable together about said interconnection.

24. An assembly as set forth in claim 23 wherein said housing covers include dielectric structure extending vertically through aligned medial slots of said first and second cables and between said interconnecting structure assemblies.

25. An assembly as set forth in claim 23 wherein said housing covers are identical and hermaphroditic.

26. An assembly as set forth in claim 23 wherein said hermaphroditic housing covers include respective dielectric structures extending vertically through aligned medial slots of said first and second cables and between said interconnecting structure assemblies, said dielectric structures comprising axially extending wall sections laterally offset from the center, thereby being adapted to extend past each other upon said hermaphroditic housing covers being secured together about said interconnection.

27. An assembly as set forth in claim 23 wherein said housing covers include respective resilient cable-clamping means for firmly clamping major side surfaces of at least a first said cable extending from said interconnection and defining a first cable exit, providing assured insulation at said first cable exit of the interconnection and vibration resistance for at least a limited range of cable thicknesses at said cable exit.

28. An assembly as set forth in claim 27 wherein said cable-clamping means is integral with said housing covers and comprises cable-engaging platforms deflectable outwardly against spring bias upon cable engagement into relief slots therebehind.

29. A method of interconnecting a pair of flat cables, comprising the steps of:

preparing the cables by forming an axially extending slot along the center of each said cable at a selected interconnection site;

placing one said cable over the other parallel thereto and aligning said slots vertically, and aligning conductor means of an upper one of said stacked cables with a lower one thereof to be interconnected;

applying on each lateral side of said slots a respective at least one pair of upper and lower conductive interconnecting structures to an upwardly facing surface of said upper one of said stacked cables and a downwardly facing surface of said lower one of said stacked cables respectively, for portions of said conductive interconnecting structures to enter electrical engagement with portions of associated said conductor means of upper and lower ones of said cables to be interconnected, thus electrically interconnecting said associated conductor means of said cables, said respective at least one pair of conductive interconnecting means on each side of said slot being spaced from the other thereof at said slots; and applying housing means about said interconnecting site enclosing said conductive interconnecting structures and said portions of said associated conductor means so that a vertical portion of said housing means extends through said slots between said conductive interconnecting structures, whereby the conductive interconnecting structures are electrically isolated by dielectric material of said housing means.

30. A method of interconnecting a pair of flat cables, comprising the steps of:

placing one said cable over the other parallel thereto and aligning conductor means of an upper one of said stacked cables with a lower one thereof to be interconnected;

selecting upper and lower conductive interconnecting structures each having lateral sections joined initially by ligature means to extends transversely across a width of said cable, with said ligature means associated with a narrow medial region of said cable;

applying said upper and lower conductive interconnecting structures to an upwardly facing surface of said upper one of said stacked cables and a downwardly facing surface of said lower one of said stacked cables with said ligature means extending across said narrow medial regions of said stacked cables, for said lateral sections of said conductive interconnecting structures to enter electrical engagement with potions of associated said conductor means of upper and lower ones of said cables to be interconnected, thus electrically interconnecting said associated conductor means of said cables;

shearing and thereby removing said ligature means and adjacent narrow medial portions of said stacked cables, thereby separating said lateral sections of said upper and lower conductive interconnecting structures and defining electrically isolated interconnecting means and forming aligned axially extending slots along the center of said stacked cables; and applying housing means about said interconnection site enclosing said conductive interconnecting structures and said portions of said associated conductor means so that a vertical portion of said housing means extends through said slots between said conductive interconnecting structures, whereby the conductive interconnecting structures are electrically isolated by dielectric material of said housing means.

31. A pair of adapter members for interconnecting selected portions of first and second flat cables with the selected potions being superposed and having aligned side edges defining a known common width and including associated conductor means to be electrically interconnected, comprising:

first and second adapter members each having an electrical interconnection region, at least said first adapter member including a plurality of bosses extending from a cable-proximate surface thereof and at least said second adapter member including a like plurality of corresponding boss-receiving recesses, said bosses adapted to extend through the planes of said first and second flat cables and enter respective said boss-receiving to establish electrical connections between said cable conductors; and each of said first and second adapter members including end sections extending axially from opposing ends of said interconnection region thereof, said end sections having a transverse dimension at least as wide as said known common width of said selected cable portions and defined transversely between first and opposed second common lateral edges, said end sections of each said adapter ember associated with an opposed from said end sections of the other said adapter member for application to said selected cable portions such that said associated opposed end sections are disposed against major surfaces of said first and second flat cables, each said end section including at least one tab-receiving recess along and extending inwardly from said first lateral edge thereof, and including at least one tab section extending outwardly from said second lateral edge thereof and bent vertically toward an associated said tab-receiving recess of an associated said end section along said first lateral edge thereof, each said tab section thereby extending past said aligned side edges of said selected cable portions and adapted to be received therethrough said first and second adapter members have been pressed onto said cable portions interconnecting said conductors, and thereafter be bent over against a remote surface of said associated end section towards said second lateral edge of said associated adapter member, securing said adapter members together and to said first and second cables about said selected portions thereof without penetrating insulation of said cable portions, thereby not tending to relatively misalign said bosses and said boss-receiving recesses during termination to said cable portions.

32. A pair of adapter members as set forth in claim 31 wherein said interconnection region of each said adapter member includes a plurality of said bosses extending from a cable-proximate surface alternating with a like plurality of said boss-receiving recesses and is thus intermatable with a like interconnection region of the other adapter member when the firs and second adapter members are properly aligned with bosses of one opposing recesses of the other, whereby said first and second adapter members are identical and hermaphroditic.

* * * * *

UNITED STATES PATENT OFFICE

CERTIFICATE OF CORRECTION

Patent No. 4,975,081 Dated December 4, 1990

Inventor(s) John K. Daly et al.

It is certified that error appears in the above-identified patent and that said Letters Patent is hereby corrected as shown below:

In the Claims:

Claim 30, line 49, column 14 - the word "extends" should be --extend--.

Claim 31, line 16, column 15 - the word "potions" should be --portions--.

Claim 31, line 28, column 15 - the word --recesses-- should be added after the word "boss-receiving".

Claim 31, line 37, column 15 - the word "ember" should be --member--.

Claim 32, line 34, column 16 - the word "firs" should be --first--.

Signed and Sealed this

First Day of December, 1992

*Attest:*

DOUGLAS B. COMER

*Attesting Officer*

*Acting Commissioner of Patents and Trademarks*